US005125192A

United States Patent [19]

Welsch

[11] Patent Number: 5,125,192

[45] Date of Patent: Jun. 30, 1992

[54] FLEXIBLE SANDING/DEBURRING HEAD

[75] Inventor: Walter N. Welsch, Tonawanda, N.Y.

[73] Assignee: Dynabrade, Inc., Clarence, N.Y.

[21] Appl. No.: 750,105

[22] Filed: Aug. 26, 1991

[51] Int. Cl.[5] ..... B42D 11/00

[52] U.S. Cl. ..... 51/395; 51/170 PT; 51/209 R; 51/401

[58] Field of Search ..... 51/394, 395, 397, 401, 51/406, 170 R, 170 PT, 170 T, 209 R

[56] References Cited

U.S. PATENT DOCUMENTS

| | | | |
|---|---|---|---|
| 2,749,681 | 6/1956 | Reidenbach | 51/395 |
| 3,081,584 | 3/1963 | Bullard | 51/209 R |
| 3,653,858 | 4/1972 | Field | 51/406 X |
| 3,959,935 | 6/1976 | Stuppacher | 51/395 |

*Primary Examiner*—Douglas D. Watts

*Attorney, Agent, or Firm*—Bean, Kauffman & Spencer

[57] ABSTRACT

A flexible sanding/deburring head adapted for driven rotation by a power tool is formed from a plurality of juxtaposed thin sheets of flexible abrasive material individually die cut to define a connecting portion having a mounting opening disposed centrally thereof and at least three projections connected to the connecting portion to extend generally radially of the mounting opening, wherein the projections are uniformly spaced annularly of the mounting opening and bound uniformly sized cut-out areas opening radially of the mounting opening and each projection is divided into parallel fingers having relatively inner ends connected to the connecting portion and relatively outer ends arranged to lie generally along arcs of a circle whose center is coincident with the center of the mounting opening.

12 Claims, 2 Drawing Sheets

FLEXIBLE SANDING/DEBURRING HEAD

BACKGROUND OF THE INVENTION

Sanding/deburring heads formed by joining together a plurality of skip-cut strips of flexible abrasive sheet material in a fan shaped orientation are well known and commonly referred to as "Star" heads. Star heads are widely used to perform wood sanding and metal deburring operations depending on the rotational speed at which the heads are driven and/or the composition of the sheet materials from which the skip-cut strips are formed.

Star heads are typically formed by first providing parallel lengthwise extending skip-cuts in an elongated strip of suitable abrasive material, such as may be supplied by a roll, and then transversely severing the elongated strip to provide individual strips whose lengths correspond to the diameter of a head to be formed. As an incident to the forming operation, the individual strips are each provided with a centrally located mounting opening. After the individual strips are formed, they are assembled on a mandrel with their mounting openings disposed in alignment and to lie in a fan-like orientation, wherein the edges of adjacent strips overlie one another in a direction extending annularly of the mounting openings until a sufficient number of strips are assembled to provide a disc-shaped, plan view configuration. Thereafter the assembled strips are joined by a grommet bounding their mounting openings Star heads suffer the drawbacks of their being relatively expensive to manufacture and relatively stiff, as compared to the abrasive material from which they are formed. Moreover, the degree of stiffness of Star heads increases as their diameters decrease, due to the wearing away of their peripheries during use, and as a result, Star heads became unsuitable for sanding contoured surfaces after relatively little use.

SUMMARY OF THE INVENTION

The present invention is directed toward an improved head for performing sanding and/or deburring operations, and more particularly towards a flexible sanding/deburring head possessing advantages over present Star heads.

In accordance with the present invention, a flexible sanding/deburring head is formed from one or more head units, which comprise a plurality of juxtaposed thin sheets of flexible abrasive material individually die cut to define a connecting portion having a centrally located mounting opening and three or more projections connected to the connecting portion to extend generally radially of the mounting opening. The projections are preferably uniformly spaced apart annularly of the mounting opening and bound uniformly sized, generally V or wedge-shaped, cut-out areas opening radially outwardly of the connecting portion. Each projection is divided into parallel fingers having inner ends connected to the connecting portion and outer ends arranged to lie along arcs of a circle whose center is coincident with the center of the mounting opening The projections and areas of adjacent sheets are disposed in alignment, and the fingers of each projection are preferably unconnected throughout their lengths.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
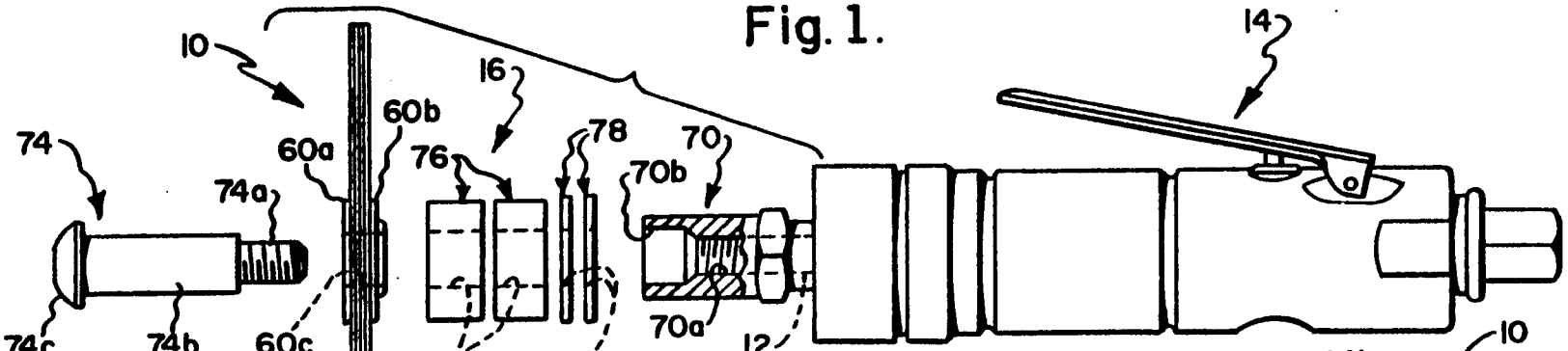
FIG. 1 is an exploded view illustrating one mode of mounting a sanding/deburring head of the present invention on a rotor power tool.

Reference is first made to FIG. 1, wherein a flexible sanding/deburring head formed in accordance with the present invention is generally designated as 10 and shown as being adapted to be mounted on a rotatable output or drive shaft 12 of a conventional, hand manipulated, pneumatically driven tool 14 by an adjustable mounting assembly 16. The term sanding/deburring is intended to designate a head formed of flexible abrasive sheet material and capable of performing a wide range of abrading operations depending upon the characteristics of the sheet material employed in its fabrication and the rotation speed at which it is driven.

Figure 2:
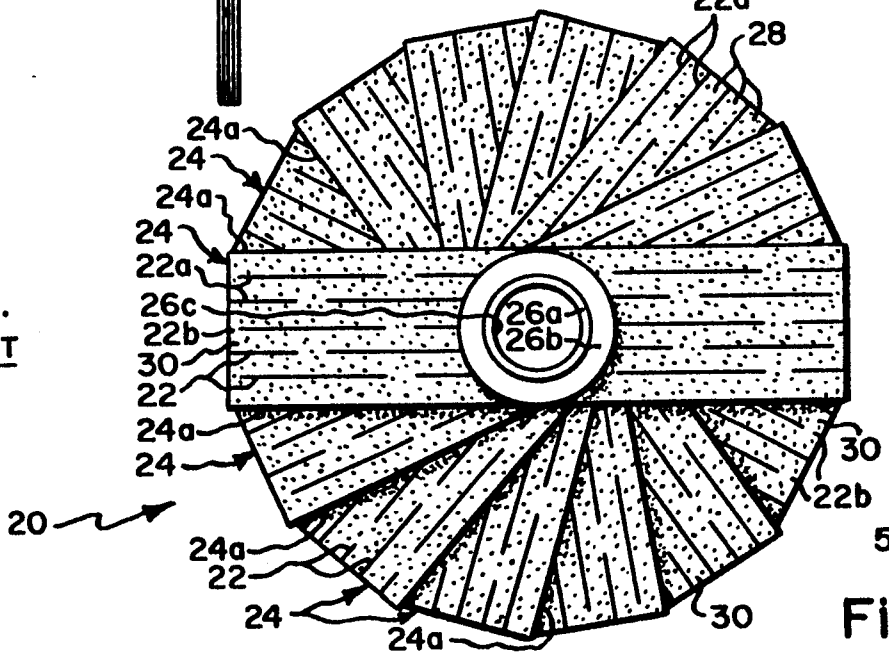
Fig. 2. PRIOR ART
FIG. 2 is a plan view of a Star head.

In FIG. 2 there is shown a well known prior type of sanding/deburring head designated as 20 and known as a "Star" head. Star head 20 is typically formed by transversely severing an elongated strip of flexible abrasive material having parallel skip-cuts 22 extending lengthwise thereof to provide a plurality of individual strips 24 whose lengths correspond to the diameter of the Star head to be formed. As an incident to forming strips 24, each is formed with a mounting opening, not shown, which is centered lengthwise and widthwise thereof. Star head 20 is assembled by laying-up a first group of strips 24 one at a time with their mounting openings disposed in alignment, their abrasive surfaces facing in a common direction and their adjacent lengthwise extending edges 24*a* disposed to lie in an overlapping relationship, until a sufficient number of strips has been laid up to create the generally disc-shaped, plan view configuration depicted in FIG. 2. A second group of like numbered and arranged strips 24 is then laid-up on the first group, but with the abrasive surfaces of the second group facing away from the abrasive surfaces of the first group. Thereafter, the stack of strips formed by the first and second groups of strips 24 is permanently assembled by a metal grommet defined by ring parts 26*a* and 26*b*, wherein ring part 26*a* extends through the mounting openings of the strips and is mechanically joined to ring part 26*b*. Typically, a plurality of individual assemblies or head units of the type described are permanently assembled together in an axially aligned and axial end-to-axial end abutting relationship to provide a Star head of desired axial length by attaching, as by adhesive, the individual assemblies to a common mounting or drive shaft, not shown, which extends axially through the central opening 26*c*of their respective grommets.

In a typical Star head of the type shown in FIG. 2, the pattern of skip-cuts 22 of the individual strips 24 is not uniform, such that for some strips their cut portions 22*a* extend to the outer periphery of the Star head, whereby to divide the outer ends of such strips into separate individually movable fingers 28, whereas for other strips their uncut or unsevered portions 22b extend to the outer periphery of the Star head, whereby the outer ends of these latter strips are partially divided into pairs of edge joined fingers 30. As a result, the abrading characteristics of a Star head is peripherally non-uniform even when first placed into use. Even if care were to be taken to provide each of strips 24 with a uniform pattern of skip-cuts 22, a Star head created from such strips would develop non-uniform abrading characteristics upon sufficient wearing away of its periphery, to expose only cut portions 22a or both cut portions 22a and uncut portions 22b adjacent the outer ends of the strips.

In a typical commercial 4 inch diameter Star head of the type described, strips 24 each have lengths of 4 inches and widths of about 1 1/16 inch, and the first and second groups of strips have 7 strips each, such that each individual assembly or head unit includes 14 individual strips of 15 abrasive material joined together by a common grommet.

Figure 3:
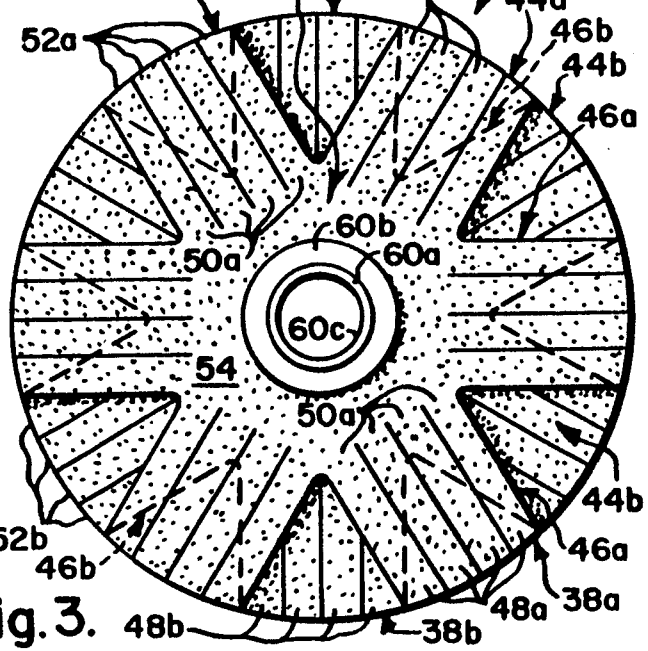
FIG. 3 is a plan view of a sanding/deburring head formed in accordance with the present invention.
Figure 4:
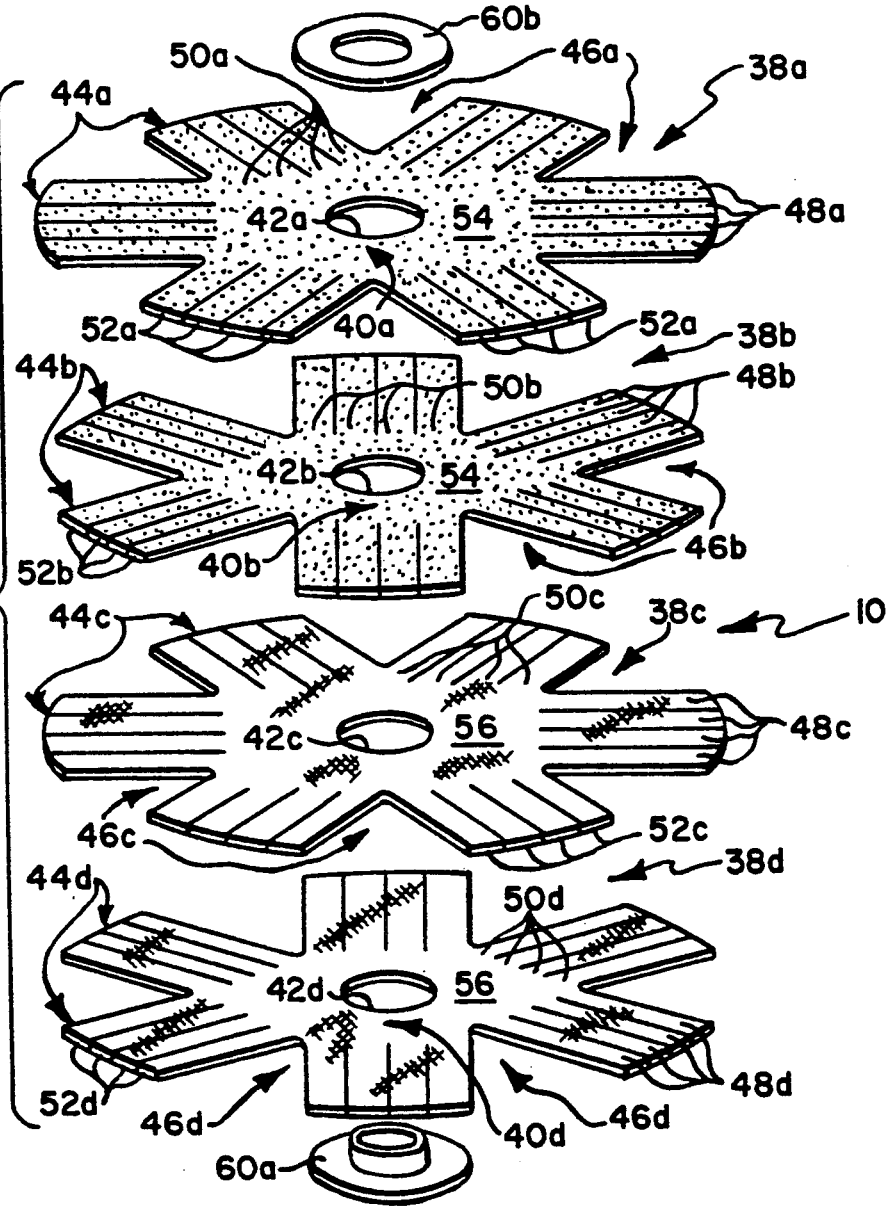
FIG. 4 is an exploded, perspective view of the head shown in FIG. 3.

Head 10 of the present invention is shown, for example, in FIGS. 1, 3 and 4 as being defined by four sheets of a suitable, relatively thin, flexible abrasive material 38a -38d, which are shaped to define connecting portions 40a-40d having centrally located mounting openings 42a-42d and a plurality of projections 44a 44d connected to their associated connecting portions and arranged to extend generally radially with respect to their associated mounting openings in a uniform annularly spaced relationship. Adjacent projections 44a-44d cooperate to bound essentially uniformly sized cut-out areas 46a-46d. Projections 44a-44d are divided into a plurality of parallel fingers 48a-48b, which are preferably unconnected to each other throughout their lengths and have their relatively inner ends 50a-50d connected to their associated connecting portions 40a-40d and their relatively outer ends 52a-52d arranged to lie essentially along arcs of a circle whose center is coincident with the center of their associated mounting openings 42a-42d.

As for the case of prior Star heads, in the present wheel, sheets 38a-38d would typically be cut from stock material having an abrasive surface 54 and a relatively nonabrasive surface 56 defined by a woven or other suitable carrier material to which abrasive material is bonded to create the abrasive surface. Preferably, sheets 38a-38d are arranged in first and second groups of adjacent sheets, e.g. sheets 38a, 38b and sheets 38c, 38d, wherein the abrasive surfaces of adjacent sheets of a first group face in a direction away from the abrasive surfaces of adjacent sheets of the second group, as generally shown in FIG. 4. Thus, abrasive surfaces of sheets 38a and 38d are intended to define the axially opposite ends of head 10 with the abrasive surfaces of sheets 38b and 38c being arranged in a facing relationship to the relatively non-abrasive surfaces of sheets 38a and 38d, respectively, and with the non-abrasive surfaces of sheets 38b and 38c being arranged in a facing relationship. The number of sheets in each group may be varied, as desired, but a head having two sheets in each group is preferred.

Sheets 38a-38d are suitably joined together to define an assembled head unit, such as for example, by a conventional metal grommet defined by ring parts 60a and 60b, wherein ring part 60a extends through mounting openings 42a-42d and is mechanically joined to ring part 60b for purposes of clamping sheets 38a-38d in juxtaposition or in a stacked relationship. The means employed to assemble sheets 38a-38d in stacked relation is in no way limiting on the present invention.

When sheets 38a-38d are assembled, projections 44a -44d and areas 46a-46d of adjacent sheets are arranged to lie in alignment. Thus, projections 44a are aligned with areas 46b, which are aligned with projections 44c, which are in turn aligned with areas 46d. Preferably, the widths of projections 44a-44d, as measured transversely of fingers 48a -48b, are essentially equal to or exceed the widths of areas 46a-46d, as measured between adjacent projections at the outer ends 52a-52d of their respective fingers, whereby the projections of the sheets bridge across the areas of adjacent sheets, as best shown in FIG. 3.

FIGS. 3 and 4 depict a proposed 4 inch diameter head defined by 4 sheets each having six uniformly sized projections and six uniformly sized cut-out areas of generally V-shaped or wedge-shaped design. For this size head, the lengths of fingers 48a-48d would equal or slightly exceed the widths of projections 44a-44d, and the number of fingers formed from each projection would typically range between 4 and 7 depending upon the abrading operation to be performed.

Heads formed in accordance with the invention are not limited as to diameter and numbers or sheets, projections and fingers employed, except that each head must include a minimum of two sheets, each sheet must have a minimum of three projections and each projection must have a minimum of two fingers to provide a unit of even limited service. On the other hand, the maximum number of projections employed and the widths thereof are limited by the requirement that the sheets must have cut-out areas whose radial extent is not substantially less than the length of the projection fingers. The maximum number of fingers into which the projections are divided is limited by the strength of the abrasive material and/or the type of sanding or deburring operation to be performed. As a general rule, the larger the number of fingers provided, the softer the feel of the head and the greater its ability to sand contoured surfaces without imparting scratches or sanding marks thereto.

By again referring to FIG. 1, it will be understood that adjustable mounting assembly 16 allows for the removable mounting of one or more heads 10 for driven rotation by tool 4. Specifically, assembly 16 includes a mounting socket 70 formed with a stepped diameter axially, extending opening having a screw threaded end portion 70a and a enlarged diameter bore end portion 70b; a clamping screw 74 formed with a screw threaded end portion 74a, an enlarged diameter cylindrical or central bearing portion 74b and a clamping or head portion 74c; a pair of relatively thick washers or spacers 76, 76 having through bearing openings 76a, 76a; and a pair of relatively thin washers or spacers 78, 78 having through bearing openings 78a, 78a. Threaded end portion 70a is sized to threadably receive drive shaft 12 and threaded end portion 74a, and bore end portion 70b, bearing openings 76a, 76a, 78a and 78a, and through opening 60c of grommet ring part 60a are sized to slidably receive bearing portion 74b of clamping screw 74. The axial lengths of the individual elements comprising assembly 16 and that of head 10, as defined by grommet ring part 60a in the illustrated form of the present invention, are such that by employing washers 76, 76, 78 and 78 in various combinations, between 1 and 6 individual, like sized heads may be removably clamped for rotation with drive shaft 12 upon the threading of clamping screw 74 into socket 70.

Figure 5:
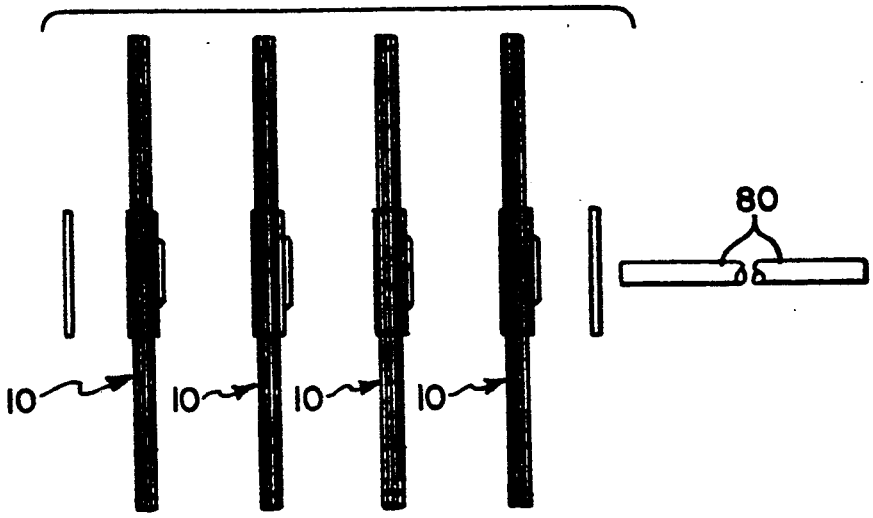
FIG. 5 is a view illustrating an alternative sanding/deburring head construction.

In FIG. 5 there is illustrated an alternative mounting arrangement, wherein a plurality of individual heads 10 of the present invention are intended to be permanently mounted in axial end-to-axial end abutting relationship on a common mounting or drive shaft 80 by means of a suitable adhesive to form a composite head of desired axial length, much in the same manner as discussed above with reference t a conventional Star head.

For purposes of comparison, tests were conducted on two 4 inch diameter heads, wherein a first head was fabricated from four prior head units or assemblies of the type shown i FIG. 2 and a second head was fabricated from four head units or assemblies of the present invention shown in FIG. 3. The abrasive material used in forming each head was of 320 Grit. The first and second heads were mounted on like pneumatically driven tools for rotation at a free or unloaded speed of about 2800 rpm, and then applied with essentially uniform pressure to the surface of a cylindrically shaped workpiece for a test period of about 2 ½ hours. During the test, it was noted that the rotational speed of the first head under load was reduced to about 2400 rpm and that the rotational speed of the second head under load was reduced to about 1900 rpm; the greater reduction in rotational speed of the second head under load apparently resulting from its fingers freely conforming to the contour of the surface of the workpiece and thereby maximize the degree or extent of frictional contact between the second head and the workpiece. At the completion of the test, it was noted that the first head had its diameter reduced to about 3 ½ inches and had become stiffer or less pliable to the touch, whereas it was noted that the second head had its diameter reduced to about 3 7/8 inches and had become more pliable to the touch, apparently due to the wearing away of abrasive particles from the surfaces of its fingers substantially throughout their radial extents. By comparison, abrasive particles appeared to have been removed from the surfaces of the strips of the first head only adjacent the reduced periphery of such head, thereby confirming failure of the first head to conform to the contoured surface of the workpiece to the same degree as the second head.

What is claimed is:

1. A flexible sanding/deburring head removably attachable to a power source for rotation about an axis, said head including a plurality of juxtaposed sheets of flexible abrasive material, each of said sheets being cut to define a connecting portion having a mounting opening disposed centrally thereof and at least three projections connected to said connecting portion to extend generally radially of said mounting opening, said projections being spaced annularly of said mounting opening and bounding essentially uniformly sized cut-out areas opening radially outwardly of said mounting opening, each of said projections including a plurality of generally parallel fingers having radially inner and outer ends, said inner ends are connected to said connecting portion and said projections of one of said sheets are aligned with said areas of a next adjacent one of said sheets.

2. A head according to claim 1, wherein the widths of said projections, as measured transversely of said fingers thereof are essentially equal to or greater than the widths of said areas as measured between adjacent projections at said outer ends of said fingers thereof.

3. A head according to claim 2, wherein each of said sheets is formed with six of said projections and six of said areas and said head is formed from four of said sheets.

4. A head according to claim 1, wherein said fingers of each of said projections are unconnected to each other between said inner and outer ends thereof.

5. A head according to claim 1, wherein said areas are V-shaped

6. A head according to claim 1, wherein said projections of one of said sheets bridge across said areas of a next adjacent one of said sheets, and said fingers of said projections are unconnected to each other between said inner and outer ends thereof.

7. A head according to claim 1, wherein said sheets each include an abrasive surface and a relatively non-abrasive surface, said sheets are arranged in first and second groups of one or more sheets, wherein the abrasive surfaces of said sheets of said first group face in a direction away from the abrasive surfaces of said sheets of said second group.

8. A head according to claim 2, wherein the lengths of said fingers, as measured between said inner and outer ends thereof, is at least equal to said widths of said projections, and said fingers of each of said projections are unconnected to each other between said inner and outer ends thereof

9. A head according to claim 8, wherein said sheets are clamped in a stacked relationship by a grommet extending through said mounting opening of each of said sheets.

10. A head according to claim 8, wherein said areas are V-shaped.

11. A head according to claim 10, wherein said head includes four of said sheets, said sheets each include an abrasive surface and a relatively non-abrasive surface, said sheets are arranged in first and second pairs of adjacent sheets, wherein the abrasive surfaces of adjacent sheets of said first pair face in a direction away from the abrasive surfaces of adjacent sheets of said second pair.

12. A head according to claim 11, wherein each of said sheets is formed with six of said projections and six of said areas.

* * * * *